US005274347A

United States Patent [19]

Bobadilla

[11] Patent Number: 5,274,347

[45] Date of Patent: Dec. 28, 1993

[54] COAXIAL FITTING FOR MICROWAVE DEVICES

[75] Inventor: Omar J. Bobadilla, Parsippany, N.J.

[73] Assignee: AT&T Bell Laboratories, Murray Hill, N.J.

[21] Appl. No.: 928,560

[22] Filed: Aug. 11, 1992

[51] Int. Cl.[5] ..... H01P 1/205

[52] U.S. Cl. ..... 333/203; 333/134; 439/434

[58] Field of Search ..... 333/134, 203, 254, 260; 439/433, 434, 578

[56] References Cited

U.S. PATENT DOCUMENTS

| | | | |
|---|---|---|---|
| 3,725,829 | 4/1973 | Brown | 333/260 X |
| 3,750,053 | 7/1973 | LeDonne | 333/258 X |
| 3,818,389 | 6/1974 | Fisher | 333/203 |
| 3,936,125 | 2/1976 | Hutter | 333/260 X |
| 4,619,496 | 10/1986 | Forney, Jr. et al. | 439/434 |
| 4,660,004 | 4/1987 | Jachowski | 333/203 X |
| 4,855,697 | 8/1989 | Jones et al. | 333/260 X |
| 5,023,579 | 6/1991 | Bentivenga et al. | 333/203 |

FOREIGN PATENT DOCUMENTS

| | | | |
|---|---|---|---|
| 0223003 | 12/1984 | Japan | 333/203 |

OTHER PUBLICATIONS

"Connectors FSJ1-50A Superflexible Coaxial Cable", Installation Instructions, Andrew Corp., 1990.

"Connectors FSJ4-50B Superflexible Foam-Dielectric Coaxial Cable", Installation Instructions, Andrew Corp., Nov. 1990.

"Connector Design Techniques to Avoid RFI" by Charles E. Young, Naval Research Laboratory, Washington, D.C., pp. 174-184, 1976.

"Silver Plating, Electrodeposited: General Requirements", Federal Specification QQ-S-365D, Jun. 3, 1985.

"Price List Filters and Delay Lines", Penny Technologies, Inc., May 1, 1992.

"Catalog 35 Systems Planning Product Specifications Services", Andrew Corp., pp. 354-359, 1991.

"Intermod and Connectors: Silver Plate Beats Nickel" by Manny Gutsche, Mobile Radio Technology, Mar. 1992.

"An Update on Intermodulation Generation by RF Connector Hardware Containing Ferromagnetic Material" by Charles Young, Naval Research Laboratory, Washington, D.C., pp. 266-284, 1976.

*Primary Examiner*—Robert J. Pascal
*Assistant Examiner*—Seung Ham
*Attorney, Agent, or Firm*—Ruloff F. Kip, Jr.

[57] ABSTRACT

A coaxial fitting comprises, a metallic tubular ferrule having a forward portion with knurling thereon and a rearward portion with external threads thereon by which such fitting is coupleable to a coaxial cable, the fitting also comprising an inner metallic rod conductor extending in the ferrule in concentric radially spaced relation therewith, and a dielectric plug disposed in the ferrule radially in contact with the ferrule and inner conductor to maintain them in fixed relation, the plug being longitudinally in contact with an inwardly projecting internal annular shoulder in the ferrule. The knurled portion of the fitting is adapted to be press fitted into a bore formed in the housing of a microwave device to provide a port for microwaves supplied to or from such device. The metallic parts of the fitting interiorly comprise copper and have precious metal platings thereon to reduce microwave resistance losses.

2 Claims, 4 Drawing Sheets

COAXIAL FITTING FOR MICROWAVE DEVICES

FIELD OF THE INVENTION

This invention relates generally to microwave communication systems and, more particularly, to improvements in coaxial fittings adapted for use in the microwave plumbing used in such systems.

BACKGROUND OF THE INVENTION

In a base station cellular telephony system comprising transmitter and receiver units, the output of the transmitter and the input of the receiver consist, respectively, of signals in multiple channels included within a defined transmitted band of frequencies and signals in multiple channels included within a defined received band of frequencies separated by a gap in the frequency domain from the transmitted band. Such system transmits and receives signals simultaneously.

Because of the simultaneity of occurrence of signals transmitted from and received by such a system and the consequent danger of interference between these two kinds of signals, it was common practice in the past for such systems to be a simplex system in which the transmitter and receiver each had its own antenna, and the two antennas were spaced apart by a distance far enough to prevent any such interference from occurring to a significant degree.

As a cost saving measure however, the art has recently turned to instead of such simplex systems a base station cellular telephony system in which one of these two antennas is eliminated, and the system becomes a duplex system in which the one remaining antenna is a common antenna for both the transmitter unit and the receiver unit. In such a duplex system those two units and the one antenna are interlinked through a microwave plumbing assemblage comprising a duplexer and first and second interdigital bandpass filters which are respectively coupled to the transmitter's output and the receiver's input.

The duplexer comprises a "T" junction and three coaxial lines all coupled at one of their ends to such junction, a first and second of such lines being coupled at their ends away from such junction to, respectively, the output of the first filter and the input of the second filter, and the third of such lines being coupled at its end away from that junction to the common antenna. The first and second filters are designed to pass, respectively, the transmission band and the reception band and to reject signals outside of the pass band of the filter. Further, the microwave assemblage is designed to, in effect, steer signals from the transmitter to the antenna but not to the receiver and, simultaneously, to steer signals received by the antenna to the receiver but not to the transmitter. In this way, the system is intended to prevent the transmitted signals from interfering with the signals received by the receiver, and conversely.

When, however, experimental field trials were recently made of base station cellular telephony duplex systems wherein the plumbing assemblages incorporated components made in accordance with prevailing commercial practices, it was found that the sensitivity of the receiver was degraded by the presence at its input of an inordinately high level of electromagnetic interference. Such interference was in the form of intermodulation products of frequencies lying within the reception band and generated by signals in different channels in the transmitted band by having an interaction induced by non-linear electrical effects occurring within components of the microwave plumbing assemblage.

Further, the interdigital filters used in such assemblage in the field trials were significant sources of the interference in the form of intermodulation products appearing at the input of the receiver of the duplex systems tested in these trials. One of the sources in such filters of such interference were contact non-linearities caused by (a) loose contact between the filter housing and coaxial fittings providing input/output parts through the housing for such filter, and/or (b) corrosion at the place of contact of such fittings and housing.

SUMMARY OF THE INVENTION

In accordance with the invention in one of its aspects, the intermodulation product interference described above as observed during the mentioned field trials has been much reduced for the entire duplex system, and, also, for the described filters and, indeed, for any device with a microwave containing housing sustaining therein propagation of microwaves supplied to or from the device via an input/output port for such device by providing such port by a coaxial fitting comprising: a longitudinally extending metallic tubular ferrule having a forward portion with knurling thereon, and having a rearward portion with external threads thereon by which said fitting is coupleable to the end of a coaxial cable, an axially elongated metallic inner conductor extending longitudinally in said ferrule in concentric radially spaced relation therewith, and a dielectric plug disposed within said ferrule and around said conductor and in firm contact with both to maintain said conductor positionally fixed relative to said ferrule, said forward knurled portion of said ferrule being adapted to be press fitted into a bore in said housing so as to maintain said fitting in pressure contact with said housing.

BRIEF DESCRIPTION OF THE DRAWING

For a better understanding of the invention, reference is made to the following description of an exemplary embodiment thereof, and to the accompanying drawings wherein.

DETAILED DESCRIPTION OF THE EMBODIMENT

Figure 1:
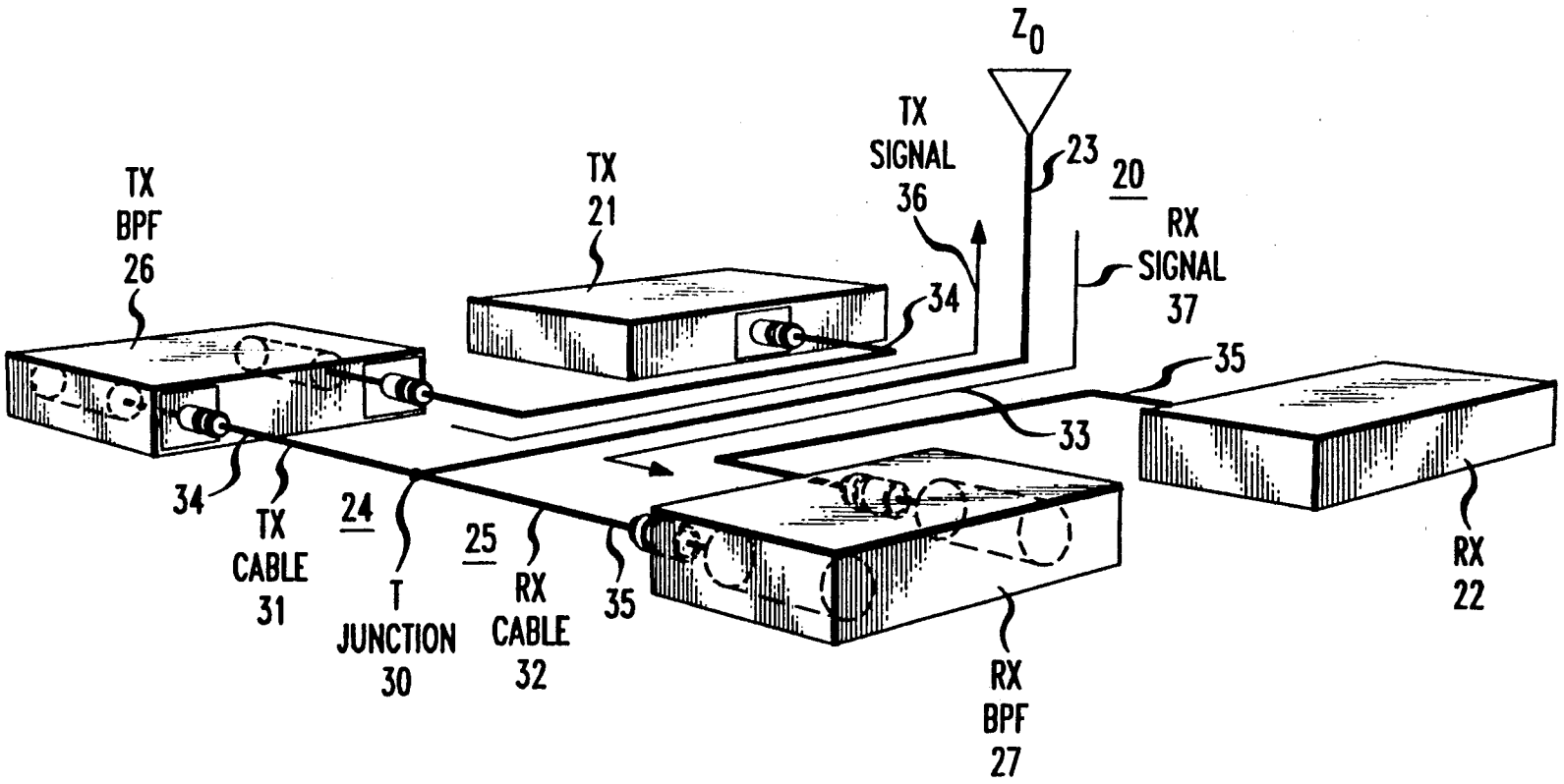
FIG. 1 is a schematic diagram of a base station cellular telephony duplex transmit-receive system embodying the invention.

Referring now to FIG. 1, the reference numeral 20 designates a base station cellular telephone duplex transmit/receive system comprising two items of microwave communications equipment, namely, a transmitter unit 21, and a receiver unit 22. The system also includes an antenna 23 common to both units 21 and 22. Elements 21, 22 and 23 are interlinked by a microwave assemblage 24 comprising a duplexer 25 and first and second interdigital bandpass filters 26 and 27.

The duplexer 25 is represented schematically in FIG. 1, and it consists of a T junction device 30 and first, second and third coaxial lines 31, 32 and 33. Lines 31 and 32 are coupled in first and second microwave transmission paths 34 and 35 extending between the T junction 30 and, respectively, the transmitter 21 and the receiver 22 so that these lines at one of their ends are coupled directly to the T junction. The first or "transmitter" filter 26 is coupled in such first path 34 between coaxial line 31 and transmitter 21 so as to provide part of such path and to pass through the filter microwave "transmitted" signals represented by arrow 36 and traveling from transmitter 21 to T junction 30 and then to antenna 23. Similarly, the second or "receiver" filter 27 is coupled between coaxial line 32 and receiver 22 to provide part of the second mentioned microwave path 35 and to pass through the filter microwave received signals represented by arrow 37 and traveling from antenna 23 via T junction 30 to receiver 22.

The coaxial lines 31 and 32 have respective electrical lengths between junction 30 and their associated filters 26, 27 which are equal to respectively $n/2\ (\lambda_t)$ and $n/2\ (\lambda_r)$ where n is an integer (which can be different for the two lines), $\lambda_t$ is a wavelength selected as typical of the transmitted signal 36, and $\lambda_r$ is a wavelength selected as typical of the received signal 37. Because lines 31 and 32 have such lengths, the transmitted signal 36 from transmitter 21 sees at junction 30 an approximately open impedance looking into line 32 towards filter 27 and, similarly, the received signal 37 from antenna 23 sees at junction 30 an approximately open impedance looking into line 31 towards filter 26. As a result the signals 36 and 37 as they reach junction 30 are preferentially steered towards, respectively, the antenna 23 and the receiver 22 as depicted in FIG. 1 by the arrows representing those signals.

When the microwave assemblage incorporates components consisting of off-the-shelf items made according to prevailing standard commercial practice, the result is, as earlier described, that the receiver 22 is badly desensitized by being exposed to an inordinately higher level of interference caused by intermodulation products derived from signals in various channels in the multiple channels in the wide hand transmitted signal 36. As also earlier mentioned, much of such interference observed in the past originated in filters 26 and 27 where such filters took the form of off-the-shelf standard commercial components. The common features of such unsatisfactory prior art filters and of improved filters according to the invention will now be described with reference to transmitter filter 26.

Figure 2:
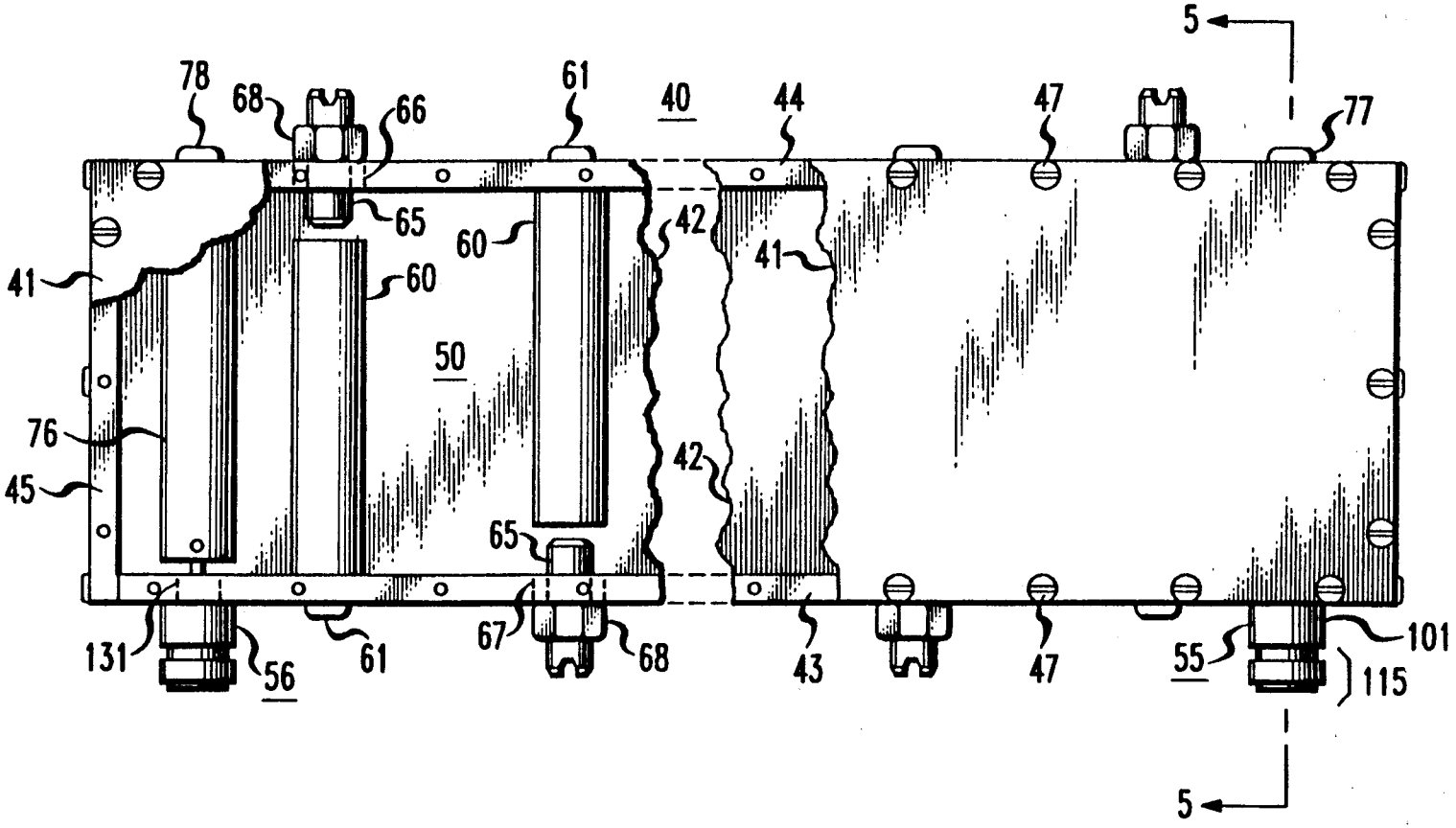
FIG. 2 is a broken-away plan view of the transmitter interdigital filter of the FIG. 1 system.
Figure 3:
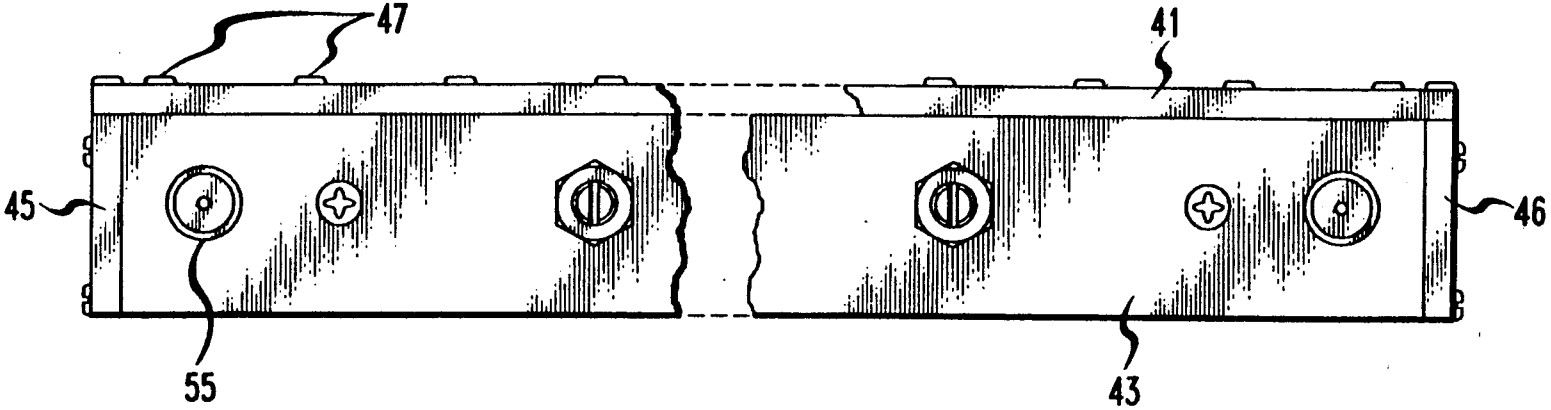
FIG. 3 is a broken-away front elevation of the FIG. 2 filter.
Figure 4:
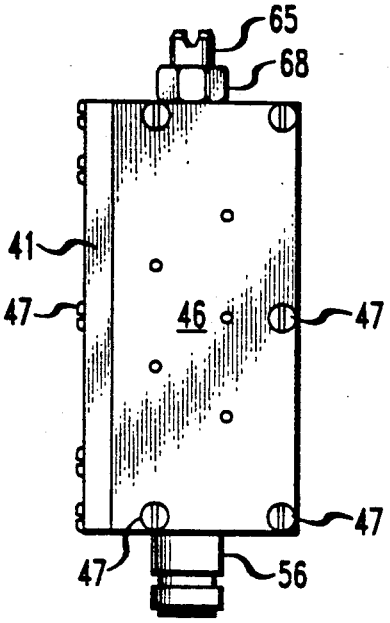
FIG. 4 is a right side elevation of the FIG. 2 filter.

Filter 26 (FIGS. 2–4) is a microwave plumbing device comprising metallic microwave containing means having in its interior a dielectric filled region sustentative of propagation therein of microwaves and enclosed by portion of such means which are at the boundary of said containing means and regions and are operably exposed to microwaves in such region. While such microwave containing means may, in accordance with the invention, takes a variety of forms, in the exemplary embodiment here disclosed, such containing means takes the form of a longitudinally elongated rectangular wave guide 40 having top and bottom walls 41 and 42, side walls 43 and 44 and end walls 45 and 46. Wall elements 41–46 are attached together by fastening screws 47. The walls 41–46 together enclose an interior dielectric filled region 50 adapted to operably sustain longitudinal propagation of microwaves therethrough. Region 50 is filled with dielectric material in the form of air, but such material may be of other kind (e.g., solid dielectric material) in other applications. Elements 40–46 are interiorly of aluminum so as to be constituted entirely of that metal except for composite coatings bonded to such aluminum and included in the portions of such wall elements bounding region 50.

Waveguide 40 at its longitudinally opposite ends has therein a pair of coaxial fittings 55, 56 mounted by the side wall 43 and respectively providing an input port and an output port for microwaves transmitted through the interior region of the wave guide. Fittings 55 and 56 and how they are mounted will be later described in more detail.

Disposed longitudinally between fittings 55 and 56 is an array of longitudinally spaced resonator rods 60 of which the axes of all the rods lie in the longitudinally extending centerplane of waveguide 40.

The rods 60 are mounted in, and extend transversely in, region 50 with the rods being mounted and fixedly positioned in that region by fastening screws 61 which alternate in the longitudinal direction between screws passing through side wall 43 and side wall 44 so as to draw their corresponding rods tight in alternation against one and the other of such walls. The result is that, in the array of rods 60, the rods alternate left to right in the longitudinal direction, as shown, between rods fastened to wall 43 and rods fastened to wall 44. There are in that array, eight or more of such rods with only two of them, however, being shown in FIG. 2 because of the broken away character of that drawing.

The resonator rods 60 cooperate with respectively corresponding tuning screws 65 disposed in region 50 in transversely spaced coaxial relation with their corresponding rods and alternating longitudinally left to right between screws passing through threaded holes 66 in wall 44 and threaded holes 67 in wall 43. As will be evident, the screws 65 can, by turning them in their holes, be adjusted in their transverse spacing from their corresponding rods 60 and, in the use of filter 26, all of such screws are appropriately adjusted in their respective transverse spacings relative to their rods 60 (i.e., are adjusted to stagger tune the rods) so as to render the filter a band pass filter which passes signals at the frequencies in the band occupied by the transmitted signal 36, but which rejects signals of frequencies outside of that pass band. After all of the screws 65 have been so adjusted to render filter 26 such a band pass filter, all of such screws are locked in the adjustment positions to which they have been set by the tightening of lock nuts 68 disposed on the outside of the waveguide on the shanks projecting therefrom of screw 65 to threadedly engage the shanks of these screws. The nuts 68 are by their turning adapted to be drawn tight against the adjacent wall of the guide so as to each thereby fixedly hold in the position to which adjusted the tuning screw encircled by the nut.

Disposed in region 50 laterally opposite coaxial fittings 55 and 56, respectively, are a pair of transversely extending feed rods 75 (FIG. 5) and 76 (FIG. 2) fixedly positioned in the region by fastening screws 77 and 78 which pass through unthreaded holes in wall 44 into threaded holes, in the back ends of the feed rods, such screws being turned to draw these rods tight against the inside of wall 44. The rods 75 and 76 are respectively coupled to fittings 55 and 56 in a manner later described in more detail.

The resonator rods 60 and feed rods 75, 76 are interiorly of aluminum and consist entirely of that metal except for composite coatings bonded to such aluminum and included in the portions of such rods bounding the region 50.

The composite coatings for the wall members 40–46 and the rods 60 and 75–76 are plated coatings described in detail in copending application Ser. No. 07/928,559 for "Microwave Transmission Means with Improved Coatings" filed of even date herewith in the name of Omar J. Bobadilla and Andy Yuk-Choi Ng and assigned to the assignee hereof. Briefly, those coating consist entirely of nonferromagnetic material, and they comprise a thin zinc layer directly bonded to the aluminum substrate provided by the elements 40–46 and 60, 75, 76, a copper layer directly bonded to such zinc layer and having a thickness of at least about 300 microinches, and a silver layer directly bonded to the copper layer and having a thickness of at least about 500 microinches, such silver layer being overlain or not, as a matter of choice, by an anti-tarnish layer produced by the well known chromate process. Further information on those composite coatings is avoidable in the patent application just referred to. Because such coatings consist entirely of nonferromagnetic material, they overcome the problem encountered in the mentioned field trials of intermodulation products being created by the presence of ferromagnetic materials in the coatings plated on the interdigital band pass filters used in those trials.

Figure 6:
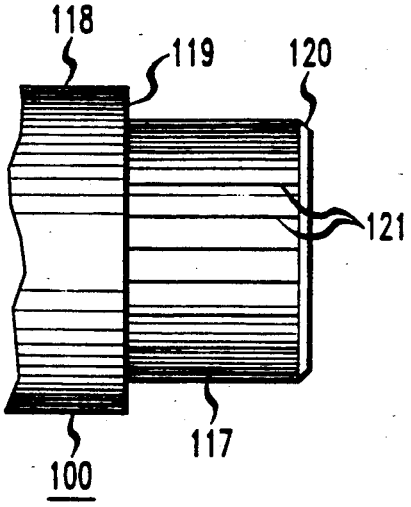
FIG. 6 is right side elevation view of part of the ferrule which is shown in cross-section in FIG. 5.
Figure 5:
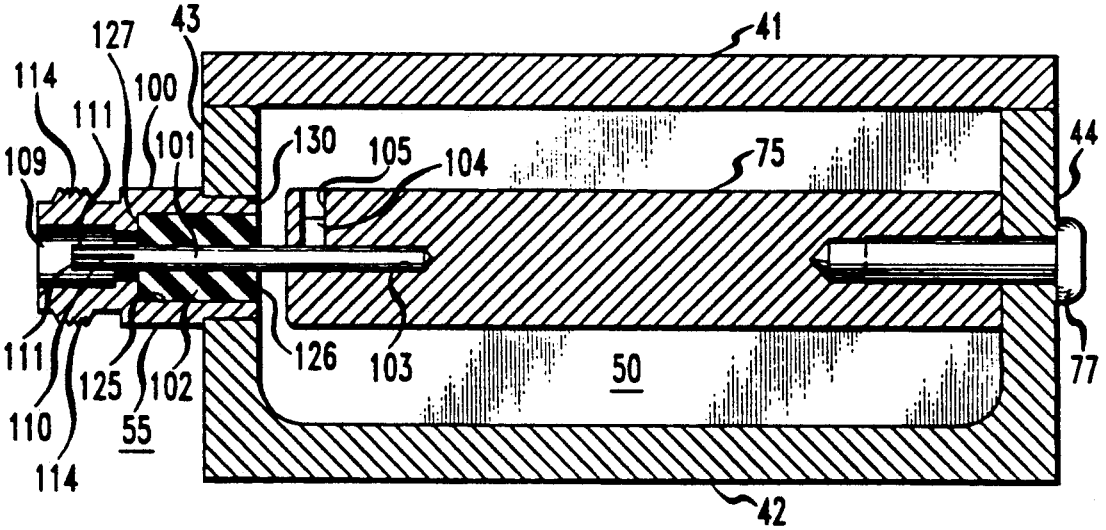
FIG. 5 is a right side elevational cross-sectional view, taken as indicated by the arrows 5—5 in FIG. 2 of the FIG. 2 filter.

Intermodulation products may be generated not only by ferromagnetic materials but also by contact nonlinearities. To reduce the chance of such products being created in filter 26 from the latter cause as a result of loose contact between coaxial fittings 55, 56 and waveguide 40 (or of corrosion at the place of such contact), such fittings and their mode of joining with the waveguide are as follows:

Referring to FIGS. 5 and 6, the fitting 55 comprises a tubular outer conductor ferrule 100, a partially hollow inner conductor rod 101 and a plug 102 of dielectric material (e.g., Teflon) interposed at the front end of the fitting between the inner and outer connectors to support them in concentric fixedly positioned relation. To the rear of plug 102, the outer conductor 100 encloses a space 109 into which projects the rear end of inner conductor 101.

The ferrule 100 is interiorly of brass and has plated on it, over its entire exterior, a silver layer plated on a copper flash on the brass and having a thickness at a minimum of at least about 300 microinches and, preferably, of at least about 500 microinches in order to reduce microwave resistane losses. The inner conductor rod 101 is made of beryllium copper with gold plating on it over its entire exterior. That is, both of the metallic parts 100 and 101 of fitting 55 are interiorly of a metallic material comprising copper (in that such material either is copper or an alloy including copper), and both of such parts 100 and 101 have a precious metal coating thereon. To provide such characteristics for those metallic parts of fitting 55 helps reduce resistance losses suffered by the microwaves in the course of their transmission through the fitting.

As shown, both the forward and rear ends of inner conductor rod 101 project outwardly from the plug 102. The forward end of the inner conductor is received with a tight fit in a matching bore 103 in the rear end of feed rod 75 and is held within that bore by a set screw 104 received in a threaded hole 105 in rod 75 to bear with pressure against conductor rod 101 when the screw is tightened. Furthermore, inner conductor 101 is joined metallurgically with Indium solder to feeder rod 75 to reduce microwave resistance losses.

The rear end of conductor rod 101 has therein a plurality of axial slits 110 angularly spaced around the rod to form at that end a plurality of resilient fingers 111. Those fingers are adapted in use to receive within them and resiliently grasp the pin tip of the inner conductor of a coaxial cable (not shown) attached to fitting 55.

The outer conductor ferrule 100 is in the form of a tubular sleeve. The rearward end of ferrule 100 has thereon exterior threads engageable with a rotatable nut (not shown) on the front end of the coaxial cable just mentioned to thereby permit coupling of such cable and fitting 55 together by turning of such nut. The forward portion 117 (FIG. 6) of the ferrule 100 is of reduced diameter relative to its middle portion 118 so that the outer surfaces of those two portions of the ferrule are joined by an annular radially extending shoulder 119. The outer circumferential surface of forward portion 117 is of generally circular cylindrical shape but is machined to have thereon a front end chamfer 120 and knurling in the form of a series of axially extending radially raised ridges 121 angularly spaced from each other around the circumference of forward portion 117. Such knurling permits the portion 117 of the ferrule to better grip the annular section 130 when pressed into it.

In assembling fitting 55 the plug 102 is placed at the front opening of the ferrule and is then pressed into the ferrule's interior 125 until the movement of the plug is stopped by its bearing forcibly against an interior shoulder 127 formed at the rearward end of the ferrules middle portion 118. Since the plug 102 has an outer diameter, greater than the inner diameter of the interior 125 of the ferrule, by so forcing the plug 102 against interior 125, the dielectric material of the plug is isotropically compressed to thus make pressure contact with both the outer conductor 100 and the inner conductor 101 of fitting 55 to thereby eliminate any possibility of looseness of fit between those two conductors.

To receive the fitting 55, the side wall 43 of waveguide 40 has formed therein a smooth walled circular cylindrical bore 130 of slightly smaller diameter than the outer diameter of the knurled portion 117 of ferrule 100 when (a) such outer diameter is measured at the outer surface of the knurled ridges 121, and (b) that front portion is radially uncompressed. In assembling the fitting 55, the ferrule's knurled portion 117 is press fitted into bore 130 to drive such knurled portion into the bore until interior shoulder 119 on the ferrule 100 makes pressure contact with the outside of waveguide wall 43. By so press-fitting the ferrule 100 into that bore, any possible loose contact between the ferrule and the waveguide 40 is done away with. Thus, by such press fitting and by the earlier described compression of dielectric plug 102, looseness is eliminated both between the fitting 55 and waveguide 40 and within such fitting, between the inner and conductors. Elimination or reduction of such looseness in turn reduces or eliminates the risk of generation of intermodulation products in filter 26 as a result of loose contact or corrosion at the junction of the fitting 55 and the waveguide 40. Concurrently, the high conductivity platings and elimination of nickel as undercoating material of the conductors 100 and 101 of fitting 55 reduces resistance losses incurred by the microwaves during their transmission through the fitting.

The coaxial fitting 56 is a duplicate in terms of structure of fitting 55 and is received in a bore 131 (FIG. 2) formed in the microwave wall 43 which is a duplicate of bore 130, the fitting 56 being press fitted into bore 131 in the same way as fitting 55 is press fitted into bore 130. The fitting 56 and the mode of its incorporation into filter 26 thus provide the same advantages as those just described with respect to fitting 55.

The receiver filter 27 is a duplicate of transmitter filter 26 except that filter 27 is adjusted so that its pass band corresponds in frequency to the frequency span of the received band of signals. It is desirable that filter 27 like filter 26 be designed to eliminate or reduce intermodulation products lying within the received band but derived from signals in the transmitted band because, even though the coaxial line 32 of duplexer 25 is, as earlier described, of an electrical length to cause the transmitted band of signals at T junction 30 to see an approximately open impedance looking towards filter 27, there will nevertheless be some leakage at a low level of signals in such transmitted band into the filter 27. Such low level signals in the transmitted band leaked into filter 27 would, however, be capable of producing in that filter intermodulation products of undersirably high strength in the received band unless the same precautions are taken in filter 27 as in filter 26 to reduce or eliminate those components.

It is further to be noted that both filter 27 and filter 26 because designed as described herein are also adapted to eliminate or reduce intermodulation products laying within the transmitted band of signals and derived from signals in the received band. Such intermodulation products would, however, in any event be, in the FIG. 1 system, of relatively low level compared to the intermodulation products derived from signals in the transmitted band.

Still further, filter 27 by virtue of being a duplicate in design of filter 26 is adapted like filter 26, as earlier described herein, to reduce resistance losses incurred by microwaves traveling through the filter.

As a result of the described measures taken herein to reduce interference and losses originating in filters 26 and 27 and of additional precautions taken in the design of duplexer 25, the interference in the FIG. 1 system has been reduced to −90 dbm measured at the pre-amp output so as to be buried in the thermal noise.

The above described embodiment being exemplary only, it is to be understood that additions thereto, omissions therefrom and modifications thereof can be made without departing from the spirit of the invention.

Accordingly, the invention is not to be considered as limited save as is consonant with the scope of the following claims.

I claim:

1. The improvement in an interdigital band pass filter comprising: a longitudinally elongated rectangular wave guide having a housing comprising metallic walls enclosing an interior dielectric filled region adapted to operably sustain longitudinal propagation of microwaves therethrough, a pair of feed rods disposed transversely in, and at opposite ends of, said region, a plurality of transversely extending longitudinally spaced resonator rods disposed in said region between said feed rods, and a pair of coaxial fittings received at said opposite ends in receptacles therefor in an apertured one of said walls and passing through such apertured wall to be coupled to corresponding ones of said feed rods so as to provide an input to and output from said region for said microwaves, said improvement being that said receptacles in said apertured wall comprise smooth circular cylindrical bores extending into said wall from its outside, and that said coaxial fittings each comprises an outer conductor in the form of a silver plated brass ferrule having a knurled forward portion press fitted into the corresponding bore and a rearward portion projecting outward from such apertured wall and having external threading thereon for coupling a coaxial line to such ferrule, and having on its inside and rearward of the front end of said forward portion of said ferrule an annular forward facing internal shoulder projecting radially inward from the interior wall of said ferrule, an inner conductor coaxial with said ferrule and extending forward into said region to an electromechanical coupling with the corresponding feed rod, and a hollow cylindrical dielectric plug interposed between said inner conductor and ferrule and maintaining said inner conductor in fixed spaced relation with said ferrule, said plug having a rear end abutting against said shoulder and having a length contained in said ferrule which is greater than said plug's outermost diameter.

2. The improvement in a base station cellular telephony duplex transmit/receive system comprising transmitter and receiver units, an antenna common to such units, and a microwave plumbing assemblage interlinking said units and antenna and comprising a duplexer having a T junction and first and second coaxial lines both coupled with said junction and respectively coupled in first and second microwave transmission paths extending between said junction and, respectively said transmitter unit and said receiver unit, said duplexer also having a third coaxial line coupled at opposite ends with said junction and said antenna, said assemblage also comprising first and second interdigital band pass filters coupled in, respectively, said first and second paths between said first and second lines and, respectively, said transmitter unit and said receiver unit, and each of said, filters being a filter comprising; a housing having walls enclosing a longitudinally elongated dielectric filled region adapted to operably sustain longitudinal propagation therethrough of microwaves in the one of said paths in which said filter is coupled, a pair of feed rods disposed transversely in, and at opposite ends of, such regions, a plurality of transversely extending longitudinally spaced resonator rods disposed in said region between said feed rods, and a pair of coaxial fittings received at said opposite ends in receptacles therefor in an apertured one of said walls to be coupled to corresponding one of said feed rods so as to provide an input to and output from said region for said microwaves, said improvement being in each filter of said first and second filters and being that said receptacles in said apertured housing wall of such filter comprise smooth circular cylindrical bores extending into said wall from its outside and respectively corresponding to said fittings, and in that said coaxial fittings of such filter each comprises an outer conductor in the form of a silver plated brass ferrule having externally knurled forward portion press fitted into the corresponding bore and a rearward portion projecting outward from such wall and having external threading thereon for coupling a coaxial line to such ferrule, and having on its inside and rearward of the front end of said forward portion of said ferrule an annular forward facing internal shoulder projecting radially inward from the interior wall of said ferrule, an inner conductor coaxial with said ferrule and extending forward into said region to an electromechanical coupling with the corresponding feed rod, and a hollow cylindrical dielectric plug interposed between said inner conductor and ferrule and maintaining said inner conductor in fixed spaced relation with said ferrule, said plug having a rear end abutting against said shoulder and having a length contained in said ferrule which is greater than said plug's outermost diameter.

* * * * *